US005916418A

United States Patent [19]

Frank et al.

[11] Patent Number: 5,916,418

[45] Date of Patent: Jun. 29, 1999

[54] IMPROVING THE LAY FLAT PROPERTIES OF PAPER FOR PRINTING

[75] Inventors: Benjamin Frank, Monsey, N.Y.; Georgios D. Karles, Midland Park, N.J.

[73] Assignee: International Paper Company, Purchase, N.Y.

[21] Appl. No.: 08/847,695

[22] Filed: Apr. 28, 1997

[51] Int. Cl.[6] ..... D21H 19/16

[52] U.S. Cl. ..... 162/135; 162/134; 162/136; 162/158; 162/182

[58] Field of Search ..... 162/135, 158, 162/164.1, 157.6, 9, 182, 164.3, 168.1, 136, 134; 106/287.24; 427/395

[56] References Cited

U.S. PATENT DOCUMENTS

| | | | |
|---|---|---|---|
| 2,785,995 | 3/1957 | Kress | 162/158 |
| 3,547,679 | 12/1970 | Moran | 117/57 |
| 4,070,319 | 1/1978 | Carel et al. | 260/29.4 |
| 4,384,894 | 5/1983 | Vickers et al. | 106/80 |
| 4,446,174 | 5/1984 | Maekawa et al. | 427/261 |
| 4,455,416 | 6/1984 | Floyd et al. | 528/245 |
| 4,537,634 | 8/1985 | Floyd | 106/214 |
| 4,906,299 | 3/1990 | Dragner | 106/214 |
| 4,936,916 | 6/1990 | Shinmitsu et al. | 106/21 |
| 5,004,600 | 4/1991 | Suzuki | 424/76.3 |
| 5,132,146 | 7/1992 | Maruyama et al. | 427/261 |
| 5,187,219 | 2/1993 | Furman, Jr. | 524/377 |
| 5,254,403 | 10/1993 | Malhotra | 428/323 |
| 5,372,984 | 12/1994 | Yamauchi et al. | 503/200 |
| 5,395,440 | 3/1995 | Trouve | 106/287.25 |
| 5,478,894 | 12/1995 | Chiang | 525/369 |
| 5,527,383 | 6/1996 | Flynn et al. | 106/243 |
| 5,541,002 | 7/1996 | Hosoi et al. | 428/537.5 |

FOREIGN PATENT DOCUMENTS 52-16940 2/1977 Japan .

OTHER PUBLICATIONS

Title: An Investigation of Methods for Dimensionally Stabilizing Paper Authors: F. W. Lorey & C. E. Libby Published by TAPPI, Aug., 1954, vol. 37, No. 8, pp. 321–331.

Title: The Reactions of Cellulose With Glyoxal Author: Frank S. H. Head Published by The Reactions of Cellulose with Glyoxal–Head—pp. T345–T356 Released for Publication by British Cotton Industry Research Association on May 2, 1958.

Title: Dimensional Stabilization of Paper by Catalyzed Heat Treatment and Cross–Linking With Formaldehyde Author: Alfred J. Stamm Publication: TAPPI, vol. 42, No. 1, Jan. 1959, pp. 44–50.

Title: Improving the Wet Rub Resistance of Starch–Clay Paper Coatings with Glyoxal Authors: G. W. Buttrick & N. R. Eldred Publication: TAPPI, vol. 45, No. 11, Nov., 1962, pp. 890–893.

Title: Gloyxal: A Unique Wet–Strength Agent Authors: N. R. Eldred & J. C. Spicer Publication: TAPPI, vol. 46 (10) (1963) pp. 608–612.

Title: Crosslinking Cotton Cellulose With Aldehydes Authors: J. G. Frick, Jr. & Robert J. Harper, Jr. Publication: Journal of Applied Polymer Science, vol. 27, 983–988 (1982).

Title: Glyoxal as a Non–Nitrogenous Formaldehyde–Free Durable–Press Reagent for Cotton Authors: Clark M. Welch & G. Forthright Danna Publication: 1982 Textile Research Institute—pp. 149–157.

Title: Glyoxal as a Formaldehyde–Free Durable Press Reagent for Mild Curing Applications Author: Clark M. Welch Publication: Textile Research Journal, vol. 53, Mar., 1983, pp. 181–186.

Title: Low, Medium, and High Tempeature Catalysts for Formaldehyde–Free Durable Press Finishing by the Gloyxal–Glycol Process Authors: Clark M. Welch & Julie G. Peters Publication: Textile Research Institute, Jun., 1987, pp. 351–356.

*Primary Examiner*—Peter Chin
*Attorney, Agent, or Firm*—Luedeka, Neely & Graham, PC

[57] ABSTRACT

The specification discloses a method for improving the lay flat properties of paper which comprises applying to a cellulosic fibrous web an aqueous solution consisting essentially of a dialdehyde, preferably glyoxal, and from about 50 to about 150 parts by weight of a polyol, preferably glycerol, per 100 parts of the dialdehyde and then drying the web at a temperature sufficient to cure the glyoxal and polyol. The concentration of dialdehyde and polyol in the solution is sufficient to provide a combined total of from about 0.1 to about 10 weight percent dialdehyde and polyol in the web based on the oven-dry weight of the paper. The solution is preferably applied in a papermaking process at or after the wet press and prior to treating the web with chemicals having free hydroxyl groups which may react with the dialdehyde.

27 Claims, No Drawings

IMPROVING THE LAY FLAT PROPERTIES OF PAPER FOR PRINTING

FIELD OF THE INVENTION

The present invention relates to methods for making paper and in particular to methods for making paper for printing applications, especially ink jet printers.

BACKGROUND OF THE INVENTION

Important characteristics of paper used in printing applications are the "lay flat" and "cockling" properties of the paper. Any wave or undulation in paper can result in poor print quality. Such undulations can arise, for example, when paper is wetted or exposed to humidity. This behavior is generally more pronounced when the paper undergoes humidity cycling which can cause the edges of the paper to curl inward resulting in surface height variations. The localized surface variations or buckling is known as "cockling" and originates from built in strains that are released and cause the local expansion or contraction of the paper. The more macroscopic curl behavior originates in the two-sidedness of the sheet and depends on time as well as humidity.

Depositing ink on paper can cause or contribute to more pronounced cockling. This is referred to as "wet cockle". As the ink dries on the paper the undulations diminish and the resulting deflections in the paper as compared to a flat sheet are referred to as "dry cockle". The severity of both wet and dry cockle is largely paper dependent, more specifically dependent on such variables as fiber furnish, basis weight and formation.

Wet cockle can be a severe problem in ink jet printing applications since wet cockle may lead to "head crash", where the print head contacts the paper as it travels up and back during printing, resulting in smearing, paper jams, and damage to the printing machine. Dry cockle and curl can adversely affect the appearance of the paper for the end user.

SUMMARY OF THE INVENTION

Accordingly, it is an object of the present invention to provide a method for improving the lay flat properties of paper.

It is another object of the invention to provide a method for limiting cockling in paper.

It is also an object of the invention to provide a method for making paper for printing applications, particularly ink jet printers.

It is a further object of the invention to provide a method for making paper with improved properties which serves as a base sheet for coatings wherein the coated paper exhibits improved printability.

An additional object of the invention is to provide paper which exhibits improved lay flat properties when exposed to humidity or wetting such as in printing operations, and which can be manufactured economically using known or existing papermaking processes.

With regard to the foregoing and other objects, the present invention provides a method for making printing paper which comprises applying to a cellulosic fibrous web an aqueous solution consisting essentially of a dialdehyde, preferably glyoxal, and from about 50 to about 150 parts by weight of a polyol, preferably glycerol, per 100 parts of dialdehyde and then drying the web at a temperature sufficient to cure the dialdehyde and polyol. The concentration of dialdehyde and polyol in the solution is sufficient to provide a combined total of from about 0.1 to about 10 weight percent dialdehyde and polyol in the web based on the oven-dry weight of the paper. The solution is preferably applied in a papermaking process at or after the wet press and prior to treating the web with chemicals having free hydroxyl groups, such as starch.

Paper and cellulosic fibrous webs produced according to the invention are especially advantageous in ink jet printing to reduce or eliminate printer head crash. Moreover, certain paper grades treated according to the invention exhibit improved whiteness and brightness compared to untreated paper and maintain their initial color better than paper which has not been treated according to the invention.

Also, the treated web can be dried using drying techniques available with conventional papermaking processes without requiring high temperatures or long drying times. A further advantage is that an acid catalyst is not required for the reaction of dialdehyde and that the reaction and curing proceeds at neutral pH conditions. Thus, treatment according to the invention can be integrated into a conventional papermaking process.

DESCRIPTION OF THE INVENTION

The invention provides a method for treating a cellulosic fibrous web to improve the lay flat properties of the paper prepared therefrom and is especially well adapted for use on a papermaking machine as a treatment to the web undergoing formation prior to the final drying step. In general, the method involves applying an aqueous solution comprising a dialdehyde and a polyol to the web in particular ratios of dialdehyde to polyol and at certain application rates of the two components to the web such that the resulting paper, having been heated on the papermaking machine in the dryer section, exhibits significantly improved flatness when re-wetted or exposed to humidity and therefore substantially improved printability.

A preferred dialdehyde for use in the invention is glyoxal. Glyoxal has the formula OHCCHO and is commercially available as a solid or in the form of an aqueous solution. Either form of glyoxal may be used, however, solid glyoxal should be dispersed in water prior to combining with the polyol. It is within the scope of the invention to use other dialdehydes, including compounds having one or more dialdehyde constituents, in place of glyoxal or in combination with glyoxal wherein the result of applying the dialdehyde(s) and polyol is a printing paper which exhibits improved lay flat properties as disclosed herein.

The amount of water into which the glyoxal is dissolved is not critical and may vary within a wide range to achieve a target pick-up rate of glyoxal on the web. The lower limit of the amount of water present is such as to inhibit the formation of undesirable polyglyoxal gels. The upper limit of water is controlled by the desired concentration of glyoxal in the solution for a target pick-up rate of glyoxal in the web. The preferred ratio of water to glyoxal therefore depends primarily on the speed at which the web is moving on a papermaking machine, the manner in which the solution is applied and the desired rate of pick-up of glyoxal in the web.

The polyol contains two or more hydroxyl groups. Suitable polyols include ethylene glycol, diethylene glycol, 1,2-propylene glycol, 1,3-propylene glycol, 1,2- butylene glycol, 1,3-butylene glycol, 1,4-butylene glycol, and polyethylene glycols having the formula $HO(CH_2CH_2O)_nH$ wherein n is 1 to about 50. Mixtures of polyols may also be used. A preferred polyol is glycerol.

The polyol is present in an amount ranging from about 50 to about 150 parts by weight per 100 parts of dialdehyde. Preferably, the polyol is present in an amount of from about 75 to about 105 parts by weight per 100 parts of dialdehyde. Increasing the amount of polyol above 150 parts by weight per 100 parts of dialdehyde may increase the amount of debonding in the web, which can negatively effect the stiffness of the paper by creating an overly limp sheet. A polyol level less than about 50 parts by weight per 100 parts of dialdehyde may result in paper being brittle which negatively effects the fold properties of the sheet.

The pH of an aqueous solution of dialdehyde and polyol is generally from about 2 to about 4, depending on the concentration of dialdehyde and polyol in solution. Preferrably, the pH of the aqueous solution of dialdehyde and polyol for use in the invention is adjusted to about 6 to about 7 using a base such as sodium hydroxide.

Any method of applying the solution to the web is acceptable provided the web is impregnated with the solution. As used herein, "impregnate" refers to the penetration of the solution into the fiber matrix of the web, and to the distribution of the solution in a preferably substantially uniform manner into and through the interstices in the web. The solution therefore preferably envelopes, surrounds, and/or impregnates individual fibers substantially through the thickness of the web as opposed to only forming a surface coating on the web.

The aqueous solution of dialdehyde and polyol is advantageously applied to the cellulosic fibrous web in a papermaking process after the wet press. The treated web should be dried prior to treating the web or paper with chemicals having free hydroxyl groups such as starch or dye fixatives which could react with the dialdehyde before it is cured. For example, it has been found that glyoxal in solution may react adversely with chemicals having free hydroxyl groups in some cases resulting in an increase in the viscosity of the solution sufficient to inhibit penetration of the solution into the web or causing other deleterious effects, thereby decreasing the effectiveness of the treatment. As used herein "wet press" refers to the stage in the papermaking process just after the forming wire where the water content of the paper is decreased.

In the case where the web will not be treated on the papermaking machine with chemicals having free hydroxyl groups, the solution of dialdehyde and a polyol is preferably applied in the papermaking process at the size press which is typically located between the first and second dryer units.

The treated web is cured at the normal temperatures provided by a drying unit or a papermaking machine, preferably a steam heated drying cylinder. Drying temperatures generally range from about 50° C. to about 120° C. The residence time of the web or paper in the dryer unit ranges from about 5 seconds to about 200 seconds, depending on the temperature and speed of the papermaking machine. Generally, a residence time of about at least 30 seconds is required for lower temperatures of about 50° C. while less than about 10 seconds is required for higher temperatures of about 120° C. Preferably, the time and temperature required to cure the glyoxal and polyol in the web ranges from about 5 to about 30 seconds at a web temperature ranging from about 80° C. to about 120° C. After the web with the solution applied thereto is dried/cured, subsequent coatings or additives such as starch and dye fixatives may be applied.

Preferred means of applying the solution on a paper machine are by puddle press, size press, blade coater, speedsizer, spray applicator, curtain coater and water box. Preferred size press configurations include a flooded nip size press and a metering blade size press.

Preferred means of applying the solution on off-machine coating equipment are by rod, gravure roll and air-knife. The solution may also be sprayed directly onto the sheet or onto rollers which transfer the solution to the paper. In an especially preferred embodiment of the invention, impregnation of the web with the solution of dialdehyde and polyol occurs by means of a puddle size press.

The concentration of dialdehyde and polyol in the solution is sufficient to provide a combined total of from about 0.1 to about 10 weight percent dialdehyde and polyol in the web based on the oven-dry weight of the paper. Preferably, the concentration of dialdehyde and polyol in the solution is sufficient to provide a combined total of from about 1 to about 5 weight percent, more preferably about 2 to about 4 weight percent dialdehyde and polyol in the web based on the oven-dry weight of the paper.

Optionally, a catalyst may be added to the solution of dialdehyde and polyol to promote reaction between the dialdehyde, polyol and the cellulose fibers in the web, but it is a feature of the invention that no catalyst is generally required. Suitable catalysts include salts of polyvalent cations such as aluminum chloride and aluminum sulfate. A combination of catalysts may also be used. A catalyst may be added in an amount of from 0 to about 30 parts by weight per 100 parts by weight of dialdehyde, preferably from about 10 to about 20 parts by weight per 100 parts by weight of dialdehyde.

Paper prepared by the method of the present invention may be coated. Suitable coatings include matte coatings, cast coatings and starch coatings. Such coatings and their method of application are well known in the art.

Treatment of paper and cellulosic fibrous webs according to the invention enhances the printability of paper by improving the "lay flat" and "cockle-free" properties of the paper, and is especially advantageous for paper to be used in ink jet printers to reduce or eliminate episodes of printer head crash.

Ink jet printers eject droplets of ink from a printing head onto paper. The print head can be relatively wide extending across the width of the paper, or it can be relatively narrow and mounted for transverse movement from one side of the paper to the other. The paper which may be of varying widths and lengths is advanced past the head by a suitable mechanism at a rate sufficient to enable the head to perform the desired printing operation. The ink usually dries sufficiently fast to enable stacking of sheets one upon the other immediately after printing. The head is supported in close adjacency with the paper surface but is spaced slightly from the surface so as not to be in physical contact therewith. Accordingly, the flatness of the sheet is of critical importance since surface elevations can cause print head crash, and can cause a wiping or blurring of the image.

The three main types of ink jet printers are continuous, piezoelectric and bubble-jet. In continuous ink jet printers, ink is continuously jetted from a small diameter nozzle under pressure and the resultant jet stream of ink breaks into small drops. Conductive ink is used and the undesired drops of ink are deflected electrostatically away from the paper (or vice versa). In piezoelectric and bubble-jet ink jet printers, a drop of ink is ejected from the printhead onto the paper only when desired.

The following nonlimiting examples illustrate further aspects of the invention.

The ink jet printer used in the examples was a Hewlett-Packard model HP850C ink jet printer having three dye-based color inks cyan, magenta and yellow, and a pigmented black. Full sheet images printed with the printer extended to within about ½ inch of each edge of the sample sheets.

EXAMPLE 1

An aqueous solution of 10 weight % glyoxal and glycerol (total) was prepared containing about equal amounts of glyoxal and glycerol. The solution was applied to a formed, unsurface-sized paper (Hammermill Tidal DP) by means of a Dow coater in puddle press configuration having a drying drum which was set at about 95° C. (200–210° F.) to achieve about 2.5 percent combined total amount of glyoxal and glycerol on the paper. Each sample was cured on the drying drum for about 15 seconds. About thirty samples were prepared.

After printing flatness was determined by laying the sheet on a horizontal surface and measuring the "lift" of the corners and centers of the edges from the surface at room temperature (20–25° C.). The lift value was determined to be the largest displacement measurement from any of the four corners or the centers of any of the four edges of each paper sample.

The samples were rated according to the following criteria:

"excellent" flatness is defined as lift less than or equal to about 5 mm;

"good" flatness is defined as a lift less than or equal to about 7.5 mm;

"acceptable" flatness is defined as lift less than or equal to about 12 mm;

"fair" flatness is defined as lift greater than 12 mm; and

"poor" flatness is defined as lift greater than about 20 mm.

The resulting paper exhibited good flexibility and good to excellent lay flat behavior after the printing of a full sheet image on the page, even after several days. No smearing of the resulting image (which would indicate contact of the print head with the page) was observed on any of the samples.

EXAMPLE 2

An aqueous solution of 10 weight % glyoxal was prepared. The solution was applied to a formed, unsurface-sized paper (Hammermill Tidal DP) by means of a Dow coater in puddle press configuration having a drying drum which was set at 95° C. (200–210° F.) to achieve about 2.5 percent total amount of glyoxal on the paper after drying for approximately 15 seconds on the drum. After printing, the resulting paper was characterized by a flatness value of "good" to "excellent", but was brittle.

EXAMPLE 3

An aqueous solution of 10 weight % glycerol was prepared. The solution was applied to a formed, unsurface-sized paper (Hammermill Tidal DP) by means of a Dow coater in puddle press configuration having a drying drum which was set at 95° C. (200–210° F.) to achieve about 2.5 percent total amount of glycerol on the paper after drying for approximately 15 seconds on the drum. The resulting paper was limp and exhibited some cockle.

EXAMPLE 4

Water was applied to a formed, unsurface-sized paper (Hammermill Tidal DP) by means of a Dow coater in puddle press configuration having a drying drum which was set at 95° C. (200–210° F.). After drying for approximately 15 seconds on the drum, the resulting paper exhibited good flexibility but had significant cockle and curl after printing. Cockle was identified as large several millimeter bumps on the sheet in the body of the sheet lifting it off the horizontal surface. The edges curled up off the surface to an angle of approximately 90° and the resulting flatness measurement was about 40 mm. When the paper was printed, the print head was observed to contact the paper about once during every 10 prints on paper treated in this manner, with some resulting smearing or distortion of the image and occasional black streaks on the sheet due to improper ink deposition from the print head.

EXAMPLE 5

Cut sheets of formed, unsurface-sized paper (Hammermill JetPRINT) were soaked for approximately three minutes in a tray containing about 12–15 weight percent aqueous solutions of glyoxal and glycerol and were subsequently dried on a drum dryer at 100° C. for three minutes and allowed to equilibrate at 50 percent relative humidity and 72° F. for approximately 48 hours. The paper which was soaked was not run through a nip. The total pick up of glycerol and glyoxal for each of the papers excluding the control was about 5 to 6 weight percent. The total pick up refers to the amount of glyoxal and glycerol which stays with the paper after soaking, blotting, pressing and drying.

The MIT fold values of the paper for the cross machine direction were measured to determine the brittleness of the paper. MIT fold values were determined by the MIT Fold Test described in the Technical Association of the Pulp and Paper Industries (TAPPI) Test Number T511OM-88. Fold values less than 40% of the untreated paper (Control) indicate unacceptable brittleness which may lead to the paper breaking into pieces when folded or when traversing a paper path in an ink jet printer. The test results are summarized in Table I.

TABLE I

| Sample | Parts by wt. Glycerol | Parts by wt. Glyoxal | MIT Fold | % Control |
|---|---|---|---|---|
| Control | 0 | 0 | 11 | 100% |
| Sample 1 | 0 | 100 | <1 | <10% |
| Sample 2 | 25 | 100 | 1 | 10% |
| Sample 3 | 50 | 100 | 5 | 45% |
| Sample 4 | 50 | 100 | 6 | 55% |
| Sample 5 | 100 | 100 | 8 | 73% |
| Sample 6 | 125 | 100 | 9 | 82% |
| Sample 7 | 150 | 100 | 9 | 82% |

The results in Table I show that paper treated with an aqueous solution of glyoxal and glycerol where the glycerol was less than 50 parts by weight per 100 parts of glyoxal displayed fold values less than 40% based on the untreated paper (Control). Such low fold values indicate that the paper is too brittle to function satisfactorily in an ink jet printer. The results in Table I also show that paper treated with between 50 to 150 parts by weight of glycerol per 100 parts of glyoxal displayed acceptable MIT fold values which indicate that these papers are not susceptible to breaking when folded or when traversing a paper path in an ink jet printer.

EXAMPLE 6

Unsurface-sized papers (Hammermill Tidal DP) were treated with aqueous solutions of about equal parts of glyoxal and glycerol at solids concentrations from 1 to 10 percent using the draw down method where solution is applied to only one side of the sheets using a wire wound rod and the papers were dried on a drum dryer at 100° C. for three minutes.

The resulting papers exhibited curling and cockling during application and drying and again on subsequent rewetting during the printing process. The initial curl and cockle occurred as a result of uneven fiber swelling which occurs when only one side of the paper was wet. The subsequent curl and cockle indicated that treating only one side of the paper was ineffective in that the aqueous solution did not penetrate uniformly throughout the paper.

EXAMPLE 7

An aqueous solution of 10 weight % glyoxal and glycerol (total) was prepared containing about equal amounts of glyoxal and glycerol. In contrast to Example 1, the solution was applied using sequential rod metering size presses to each side of an unsurface-sized paper, applying to the two sides in series with the paper dried in between applications.

Sample 1 was prepared with even applications on each side of the paper which did not penetrate through the paper. After printing, Sample 1 was characterized by a flatness value of "fair" to "poor".

Sample 2 was prepared with uneven applications on each side of the paper. The treatment saturated the sheet and achieved full penetration through the paper. After printing, Sample 2 was characterized by a flatness value of "good".

EXAMPLE 8

An aqueous solution of 10 weight % glyoxal and glycerol was prepared containing approximately equal amounts of glyoxal and glycerol. The solution was applied to paper that previously had a surface sizing layer applied by means of a puddle size press and the paper was dried.

The solution reacted with the starch on the paper causing a dramatic increase in the viscosity of the solution, which inhibited penetration into the sheet and caused reaction with the starch instead of the cellulose fibers. The resulting paper was characterized by a flatness value of "fair".

EXAMPLE 9

A 14 weight percent aqueous solution containing about equal amounts of glyoxal and glycerol was applied to a formed, unsurface-sized paper (Hammermill JETPRINT) by means of a Beloit puddle size press to achieve about 4 weight percent combined total amount of glyoxal and glycerol on the paper.

The resulting paper was matte coated on one side using a rod metering size press and the paper was dried on a drum dryer at 100° C. for three minutes. The matte coating contained a mixture of starches, clays, colloidal silica, dye fixatives and binders and was applied at a rate of approximately 12 weight percent solids based on the oven dry weight of the treated paper. After printing, the resulting paper was characterized by a flatness value of "excellent". By comparison, untreated paper with a matte coating exhibits "fair" to "poor" flatness after printing.

While the invention has been described with particular reference to certain embodiments thereof, it will be understood that changes and modifications may be made by those of ordinary skill within the scope and spirit of the following claims.

What is claimed is:

1. A method for making printing paper which comprises applying to a cellulosic fibrous web an aqueous solution consisting essentially of a dialdehyde and from about 50 to 150 parts by weight of a polyol per 100 parts of the dialdehyde and then drying the web at a temperature in the range of from about 50° to about 120° C., wherein the concentration of dialdehyde and polyol in the solution is sufficient to provide a combined total of from about 0.1 to about 10 weight percent dialdehyde and polyol in the web based on the oven-dry weight of the paper and wherein the resulting paper exhibits substantially improved lay flat properties for improved printability as compared to an untreated web.

2. A method according to claim 1 wherein the aqueous solution is applied to the web prior to treatment of the web using chemicals having free hydroxyl groups which are capable of reacting with the dialdehyde before it is dried and cured in the web.

3. A method according to claim 1 further comprising applying a coating to the treated cellulosic fibrous web after drying.

4. A method according to claim 1 wherein the polyol is selected from the group consisting of ethylene glycol, diethylene glycol, 1,2-propylene glycol, 1,3-propylene glycol, 1,2-butylene glycol, 1,3-butylene glycol, 1,4-butylene glycol, glycerol, polyethylene glycols having the formula $HO(CH_2CH_2O)_nH$ wherein n is 1 to about 50, and mixtures thereof.

5. A method according to claim 4 wherein the polyol includes glycerol.

6. A method according to claim 1 wherein the polyol includes glycerol.

7. A method according to claim 1 wherein the polyol is present in an amount of from about 90 to about 105 weight percent per 100 parts of the dialdehyde.

8. A method according to claim 1 wherein the dialdehyde includes glyoxal.

9. A method according to claim 1 wherein the solution is applied to the web in a papermaking process at the size press.

10. A method according to claim 1 wherein the solution is applied to the web in a papermaking process at the wet press section.

11. A method according to claim 1 wherein the concentration of dialdehyde and polyol in the solution is sufficient to provide from about 1 to about 5 weight percent combined total of dialdehyde and polyol in the web based on the oven-dry weight of the paper.

12. A method according to claim 11 wherein the concentration of dialdehyde and polyol in the solution is sufficient to provide from about 2 to about 4 weight percent combined total of dialdehyde and polyol in the web based on the oven-dry weight of the paper.

13. A method according to claim 1 wherein the solution further comprises a catalyst.

14. A method according to claim 13 wherein the catalyst comprises a salt of a polyvalent cation.

15. A method according to claim 14 wherein the catalyst is selected from the group consisting of aluminum chloride, aluminum sulfate, and combinations thereof.

16. A method according to claim 1 wherein the web is dried for a time ranging from about 5 to about 200 seconds.

17. A method according to claim 1 wherein the step of applying the solution to the web comprises impregnating the web substantially throughout its thickness with the solution.

18. An improved paper for ink jet printing which is made by a method comprising applying to a cellulosic fibrous web an aqueous solution consisting essentially of a dialdehyde and from about 50 to about 150 parts by weight of a polyol per 100 parts of the dialdehyde prior to treating the web with chemicals having free hydroxyl groups which are capable of reacting with the dialdehyde to a substantial degree before it is dried and then drying the web at a temperature in the range of from about 50° to about 120° C., wherein the concentration of dialdehyde and polyol in the solution is sufficient to provide a combined total of from about 0.1 to about 10 weight percent dialdehyde and polyol in the web based on the oven-dry weight of the paper.

19. A paper according to claim 18 wherein the dialdehyde includes glyoxal.

20. A paper according to claim 18 wherein the polyol includes glycerol.

21. A paper according to claim 18 wherein the step of applying includes impregnating the web with the solution substantially through its thickness.

22. An improved printing process which comprises ink-jet printing on a paper made by a method comprising applying to a cellulosic fibrous web an aqueous solution consisting essentially of a dialdehyde and from about 50 to about 150 parts by weight of a polyol per 100 parts of the dialdehyde and then drying the web at a temperature ranging from about 50° to about 120° C., wherein concentration of dialdehyde and polyol in the solution is sufficient to provide a combined total of from about 0.1 to about 10 weight percent dialdehyde and polyol in the web based on the oven-dry weight of the paper.

23. A process according to claim 22 wherein the solution is applied to the web in a papermaking process at the wet press section.

24. A process according to claim 22 wherein the solution is applied to the web in a papermaking process at the size press.

25. A process according to claim 22 wherein the concentration of dialdehyde and polyol in the solution is sufficient to provide from about 1 to about 5 weight percent combined total of dialdehyde and polyol in the web based on the oven-dry weight of the paper and the dialdehyde and polyol are applied in approximately equal proportions by weight on the web.

26. A process according to claim 22 wherein the dialdehyde includes glyoxal.

27. A process according to claim 22 wherein the concentration of dialdehyde and polyol in the solution is sufficient to provide from about 2 to about 4 weight percent combined total of dialdehyde and polyol in the web based on the oven-dry weight of the paper.

* * * * *